United States Patent [19]

Ueda et al.

[11] Patent Number: 4,708,458

[45] Date of Patent: Nov. 24, 1987

[54] ELECTROSTATIC LATENT IMAGE DEVELOPING APPARATUS

[75] Inventors: Masahide Ueda; Tadashi Ohira, both of Toyokawa, Japan

[73] Assignee: Minolta Camera Kabushiki Kaisha, Osaka, Japan

[21] Appl. No.: 843,586

[22] Filed: Mar. 25, 1986

[30] Foreign Application Priority Data

Apr. 3, 1985 [JP] Japan ..... 60-71754

[51] Int. Cl.[4] ..... G03G 15/08

[52] U.S. Cl. ..... 355/3 DD; 355/14 D

[58] Field of Search ..... 355/3 DD, 14 D; 118/688, 689, 691

[56] References Cited

U.S. PATENT DOCUMENTS

| | | | |
|---|---|---|---|
| 4,331,184 | 5/1982 | Terashima et al. | 355/3 DD X |
| 4,342,283 | 8/1982 | Terashima | 355/3 DD X |
| 4,469,427 | 9/1984 | Kopp et al. | 355/3 DD |
| 4,572,102 | 2/1986 | Yuge et al. | 118/689 |
| 4,592,645 | 6/1986 | Kanai et al. | 355/14 D |

FOREIGN PATENT DOCUMENTS 51-47435 4/1976 Japan .

*Primary Examiner*—A. C. Prescott

*Attorney, Agent, or Firm*—Burns, Doane, Swecker & Mathis

[57] ABSTRACT

An electrostatic latent image developing apparatus for use in a copying machine or the like, which comprises a transport and supply device for circulating and transporting a developer mix while mixing and stirring the developer mix, towards a developing device for developing an electrostatic latent image formed on an electrostatic latent image carrier, a toner replenishing device for replenishing the transport and supply device with a new toner material, a toner concentration detector for detecting a toner concentration of the developer mix, a drive control for the setting of a toner concentration reference value which is operable to at least stir the developer mix separately from normal developing operation, a memory for storing a reference value detected by the detector at the time of driving toner concentration reference value setting, and a toner replenishment control for comparing a detection value of the detector with the toner concentration reference value during the normal developing operation and for actuating the toner replenishing device.

9 Claims, 6 Drawing Figures

ELECTROSTATIC LATENT IMAGE DEVELOPING APPARATUS

BACKGROUND OF THE INVENTION

The present invention generally relates to an electrostatic latent image developing apparatus for use in developing an electrostatic latent image formed on a surface of an electrostatic latent image carrier such as in an electrophotographic process or the like and, more particularly, to a reference value setting means for an automatic toner concentration control device used therein.

In general, in an electrostatic latent image developing apparatus of a type utilizing a two-component developer mix comprised of a toner powder and a magnetizeable carrier material, the toner powder has to be replenished in a quantity necessary to compensate for the consumption of the toner powder used for the development of latent images.

In view of the necessity of toner replenishment, various types of automatic toner concentration control devices have hitherto been proposed. For example, the Japanese Laid-open Patent Publication No. 51-47435 discloses the one which is so constructed that, when the concentration of the toner powder in the developer mix detected within the developing apparatus and subsequently compared with a reference value corresponding to a predetermined reference toner concentration is lower than the reference value, a toner replenishing means can be operated to replenish the toner powder.

The prior art automatic toner concentration control device of the type described above has been found having the following problem. While a reference value for a toner concentration detecting means and that for a toner replenishment control means had been fixed prior to the shipment from the factory, it often occurs that the fine adjustment and/or the re-setting thereof are required at the time of installation of a copying machine and/or at the time of subsequent replacement of the developer mix. This is because a detection output of the toner concentration detecting means changes subtly depending on the environment in which the copying machine is placed and/or the characteristics of the newly replaced developer mix.

Since the fine adjustment and/or the re-setting referred to above are performed by a servicing engineer in such a way as to turn a potentiometer on the toner concentration detecting means and/or a reference value regulator while the copying machine is being operated, that is, since the fine adjustment and/or the re-setting are carried out by a servicing engineer using his head, not only is the procedure complicated, but also the extent to which they are performed varies from one servicing engineer to another, and therefore, they cannot be always accurately performed.

SUMMARY OF THE INVENTION

It is accordingly a primary object of the present invention to provide an electrostatic latent image developing apparatus which is free of said drawbacks and capable of controlling a toner concentration of a developer mix simply as well as accurately.

Another object of the present invention is to provide an electrostatic latent image developing apparatus wherein the reference value which is automatically used as a reference for the toner concentration can be obtained regardless of deviation in characteristic of a toner concentration detecting means, the replaced developer mix and others.

These and other objects of the present invention are accomplished by providing an electrostatic latent image developing apparatus which comprises a transport and supply means for circulating and transporting a developer mix to a developing means for developing an electrostatic latent image; a toner replenishing means for replenishing the transport and support means with a new toner material; a toner concentration detecting means for detecting a toner concentration of the developer mix within the developing apparatus; a drive control means for the setting of a toner concentration reference value which is operable to at least stir the developer mix within the developing apparatus separately from normal developing operations; a memory means for storing a reference value detected by the toner concentration detecting means at the time of driving toner concentration reference value setting; and a toner replenishment control means for comparing a detection value of the toner concentration detecting means with the toner concentration reference value during the normal developing operation and for actuating the toner replenishing means.

BRIEF DESCRIPTION OF THE DRAWINGS

Other objects and advantages of the present invention will appear from the following detailed description of a preferred embodiment, reference being made to the accompanying drawings, in which.

DETAILED DESCRIPTION OF THE EMBODIMENT

Figure 1:
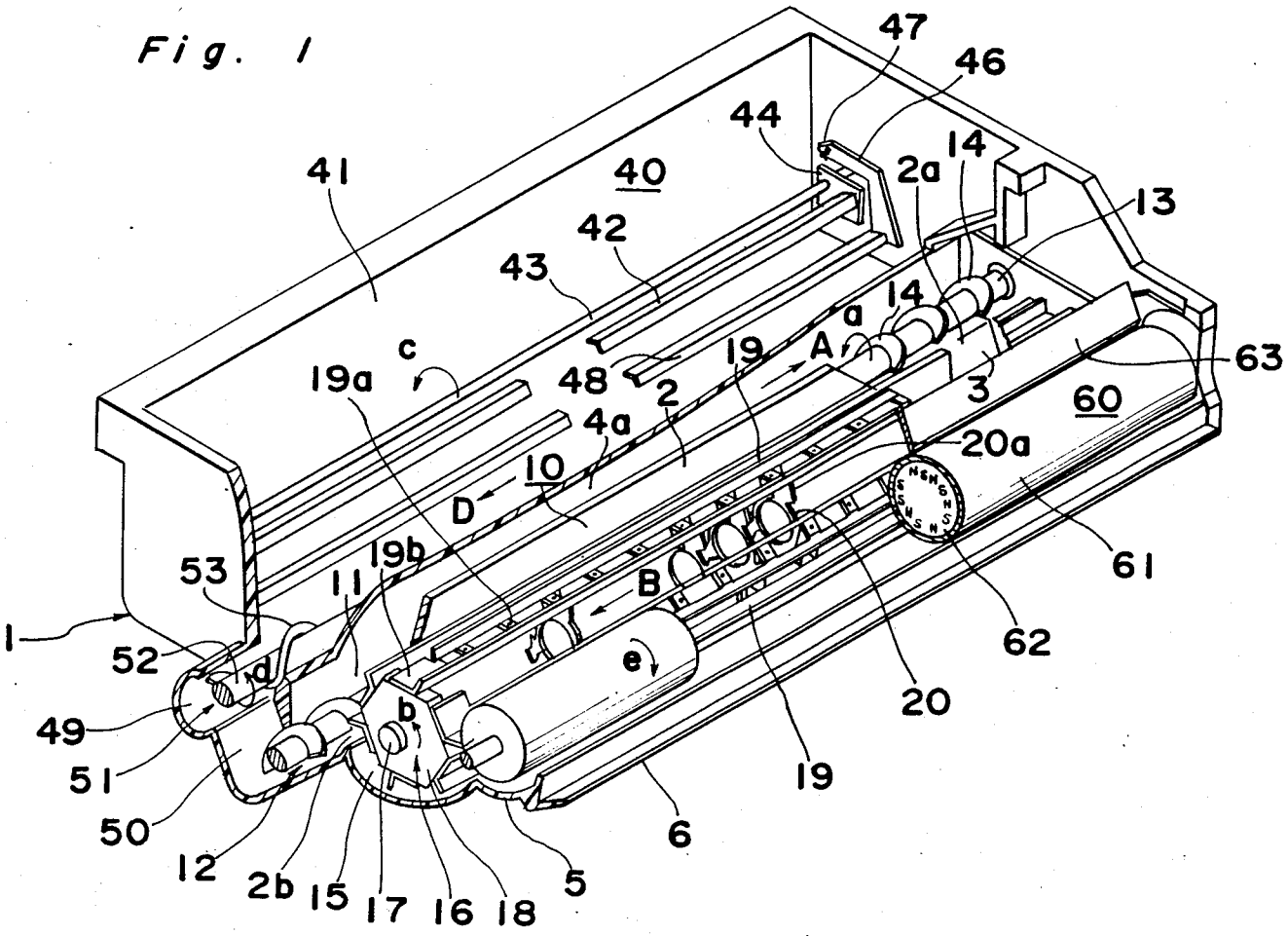
FIG. 1 is a perspective view, with a portion cut away, of an electrostatic latent image developing apparatus embodying the present invention.
Figure 2:
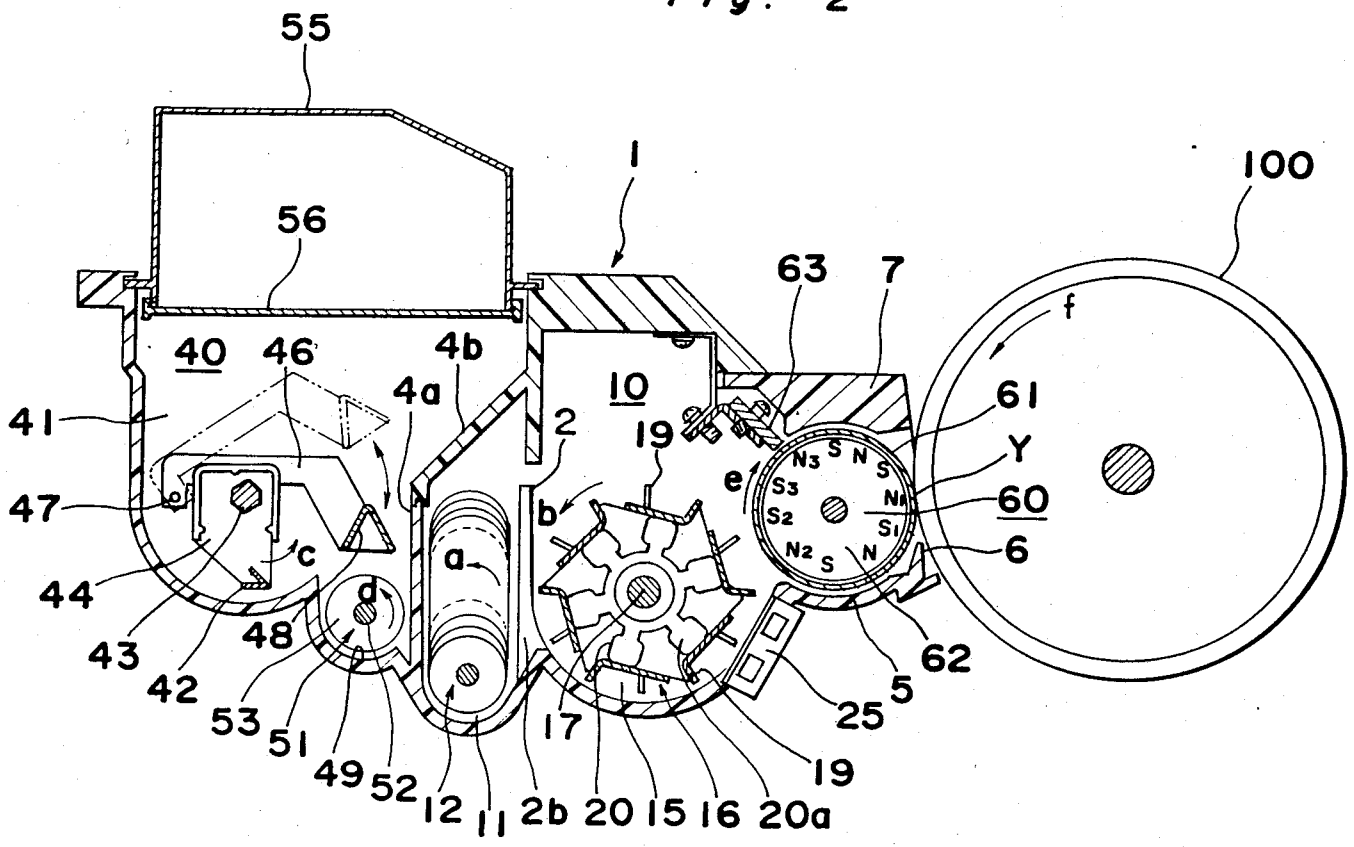
FIG. 2 is a side sectional view of the developing apparatus shown in FIG. 1.

Referring first to FIGS. 1 and 2, an electrostatic latent image developing apparatus according to the present invention comprises a developer circulating and feeding unit 10 including a screw roller 12 and a bucket roller 16, a toner receptacle 40, and a developing unit 60 including a developing sleeve 61 having a magnetic roller 62 built in the sleeve 61, all of these members being accommodated within a casing 1.

The toner circulating and feeding unit 10 has a developer mixing and conveying passage 11 and a developer supply passage 15 each defined therein by downwardly recessing the bottom of the casing 1, said passages 11 and 15 being separated from each other by a partition wall 2 raised from the bottom of the casing 1. The partition wall 2 has its opposite ends formed with respective openings 2*a* and 2*b* through which the passages 11 and 15 are communicated with each other. The passage 15 extends parallel to the developing sleeve 61, whereas the passage 11 inclined upwardly from a left-hand end towards a right-hand end thereof as viewed in FIG. 1, said right-hand end of the passage 11 having a surface area 3 continued to the opening 2*a*. It is to be noted that the surface area 3 of the passage 11 is so inclined at an angle equal to or greater than the angle of repose of the developer mix as to facilitate an easy flow of the developer mix.

The screw roller 12 comprises a support shaft 13 supported for rotation in one direction, shown by the arrow a, about its own longitudinal axis, and having its peripheral surface formed with blade segments 14 arranged in a spiral around the shaft 13 so as to protrude radially outwardly therefrom. This screw roller 12 extends within the passage 11 so as to incline at an angle equal to the angle of inclination of the passage 11 and is operable during the rotation thereof in the direction shown by the arrow a to feed the developer mix along the passage 11 in the direction shown by the arrow A while mixing and stirring the developer mix. In particular, each of the blade segments 14 has a cutout which is defined so as to extend about 180° or less about the shaft 13 for the purpose of facilitation of the thorough mixing and stirring of the developer mix.

The developer supply passage 15 is positioned at a level lower than, and so as to extend parallel to, the developing sleeve 61 and has a toner concentration sensor 25 of magnetic detection type. The toner concentration sensor 25 is installed exteriorly at a portion of the casing 1 forming the passage 15 and adjacent to the left-hand end of the passage 15 with reference to FIG. 1.

The bucket roller 16 comprises a support shaft 17 supported for rotation within the passage 15 in a direction shown by the arrow b, a pair of hexagonal end plates 18 rigidly mounted respectively on opposite ends of the support shaft 17 for rotation together therewith, elonagted buckets 19 of generally U-shaped cross-section equal in number to the number of sides of the shape of a hexagon assumed by each end plate 18, and a plurality of identical blade members 20 mounted on the support shaft 17 in equally spaced relationship with each other over the length of the support shaft 17 and positioned radially inwardly of the buckets 19 and between the end plates 18. Each of the buckets 19 has its opposite ends ridigly secured to the corresponding sides of the end plates 18, respectively, so as to extend parallel to the shaft 17 and, also, so as to open radially outwardly with respect to the shaft 17, and also has its bottom slotted so as to leave a large bottom area **19*b* adjacent the left-hand end plate 18, as viewed in FIG. 1, and a plurality of connecting pieces 19*a* spaced an equal distance from each other in a direction longitudinally thereof. The bottom of each of the generally U-sectioned buckets 19 is so slotted for the purpose of providing a relatively large latitude of freedom of movement of the developer mix, whereas the provision of the large bottom area 19*b* in each bucket 19 makes it possible to enhance the transportion of the developer mix in a direction circumferentially of the bucket roller 16**.

Each of the blade members 20 has a ring area and a plurality of, for example, six, blades **20*a* protruding radially outwardly from the ring area and twisted in a predetermined angle of 15°, each of said blades 20*a* having a small projection (not shown) which is integrally formed therewith so as to project radially outwardly therefrom and which is firmly engaged with the respective connecting piece 19*a* of the associated bucket 19**.

The bucket roller 16 is so designed and so constructed that, during the rotation of the bucket roller 16 in the direction shown by the arrow b, the developer mix can be scooped by side walls of the buckets 19 so as to be supplied onto the outer peripheral surface of the developing sleeve 61 and can be, at the same time, conveyed by the blade members 20, being rotated together with the buckets 19 about the shaft 17, in a direction shown by the arrow B in FIG. 1. It is to be noted that the blade members 20 serve not only to convey the developer mix in the direction B lengthwise of the bucket roller 16, but also to provide a reinforcement to the buckets 19 in such a way as to avoid any possible twist and/or warp of each bucket 19.

In the construction as hereinabove described, the developer mix is conveyed in the direction A within the passage 11 and in the direction B within the passage 15, based on the rotation of the screw roller 12 and the bucket roller 16 in the directions a and b, respectively. The developer mix conveyed in the direction A and subsequently reaching the right-hand, or downstream, end of the passage 11 is guided through the opening **2*a* onto the inclined surface area 3 and then into the passage 15. On the other hand, the developer mix conveyed in the direction B and subsequently reaching the left-hand, or downstream, end of the passage 15 is scooped by the bottom areas 19*b* of the respective buckets 19 towards the opening 2*b* and then into the passage 11 through the opening 2*b*. In this way, during the rotation of the screw roller 12 and the bucket roller 16, the developer mix can be circulated from the passage 11 into the passage 15 and then back into the passage 11 from the passage 15**.

It is to be noted that, since the respective levels at which the downstream ends of the passages 11 and 15 with respect to the direction of conveyance of the developer mix are located are so selected as to be higher than those at which the respective upstream ends of the passages 11 and 15 are located, the developer mix reaching the downstream ends of the respective passages 11 and 15 can positively move into the passages 15 and 11 through the openings **2*a* and 2*b*, respectively, without staying thereat, and therefore, there is no possibility of the occurrence of biases of the developer mix particularly in the passage 15**.

The developer mix being conveyed in the direction B within the passage 15 is partially scooped by the buckets 19 so as to be supplied onto the outer peripheral surface of the developing sleeve 61. Since no bias of the developer mix occurs within the passage 15, the supply of the developer mix so scooped by the buckets 19 takes place uniformly in a direction axially of the developing sleeve 61.

A magnetizeable toner material within the toner receptacle 40 is newly supplied onto the upstream end of the passage 11 by a toner supply control means as will be described later and is, after having been mixed with the existing developer mix within the passage 11, conveyed in the direction A within the passage 11 while being stirred to bear an electrostatic charge.

The toner receptacle 40 comprises a toner hopper 41 positioned rearwardly of the passage 11 with respect to the passage 15 and separated from the passage 11 by partition walls **4*a* and 4*b*, a stirring member 42 arranged within the toner hopper 41, empty detecting plates 46 arranged within the toner hopper 41, and a replenishing roller 51 also arranged within the toner hopper 41. The toner hopper 41 has a supply opening defined at the top thereof, and a toner bottle 55 containing a quantity of magnetizeable toner material is removably mounted on the toner hopper 41 in alignment with the supply opening of the toner hopper 41. The toner material within the toner bottle 55 can be released into the toner hopper 41 when a bottom closure plate 56 closing the toner bottle 55 is laterally slid to open the bottom of the toner bottle 41**.

The stirring member 42 is in the form as mounted on a support shaft 43 through end plates 44 rigid with the respective opposite ends of the shaft 43 and is rotatable in a direction, shown by the arrow c, about and together with the shaft 43 for avoiding any possible bridging and/or blocking of particles. The replenishing roller 51 comprises a support shaft 52 having a spiral blade 53 formed on the periphery thereof and is accommodated within a replenishing passage 49, defined at the bottom of the hopper 42, for rotation in a direction shown by d. A left-hand or downstream end of the replenishing passage 49 as viewed in FIG. 1 is formed with a toner replenishing slope 50 that is continued to the upstream end of the passage 11. This slope 50 has an angle of inclination equal to or greater than the angle of repose of the toner particles for the purpose of facilitation of the flow of the toner material. Thus, the toner material within the hopper 41 can be conveyed in a direction, shown by the arrow D, within the passage 49, based on the rotation of the replenishing roller 51 in the direction d and is guided into the upstream end of the passage 11 through the slope 50 at the downstream end of the passage 49. The timing and period of rotation of the toner replenishing roller 51 can be controlled by energizing and de-energizing a toner supply motor after the comparison of the toner concentration in the developer mix within the passage 15, which is detected by the toner concentration detecting sensor 25, with a reference value as will be described later.

On the other hand, the empty detecting plates 46 are pivotable about pins 47 in a direction up and down along opposite side walls of the hopper 41 within the hopper 41 and have their free ends provided with a resistant plate 48. One of the empty detecting plates 46 which is not shown in FIGS. 1 and 2 has a magnet (not shown) fixed thereto, which magnet is cooperable with a reed switch (also not shown) secured to the adjacent side wall of the hopper 41 in the vicinity of the path of movement of the magnet so that the reed switch can be switched on and off as the magnet approaches and separates away from the reed switch, respectively. The empty detecting plates 46 are so engaged with the stirring member 42 as to be pivoted upwards incident to the rotation of the stirring member 42, but can pivot downwards by gravity when the empty detecting plates 46 are disengaged from the stirring member 42. In other words, each time the stirring member 42 undergoes a complete revolution, the empty detecting plates 46 reciprocate the pivotal movement in the opposite directions about the pins 47, and during the downward pivot of the empty detecting plates 46, the resistant plate 48 receives a resistance from the toner material within the hopper 41, which resistance is proportional to the amount of the toner material within the hopper 41. As the amount of the toner material within the hopper 41 decreases, the position to which the empty detecting plates 46 are pivoted downwards is correspondingly lowered, and when the toner material is emptied, the magnet carried by one of the empty detecting plates 46 comes to activate the reed switch to effect, at an operating panel of the copying machine body, a display indicating that the tone material has been emptied.

The developing unit 60 is so constructed that the developing sleeve 61 having the magnetic roller 62 built therein is arranged between an arcuate portion of the casing 1 and a toner dust preventing plate 7, and includes a bristle height restricting plate 63 having its tip confronting the outer peripheral surface of the developing sleeve 61. The developing sleeve 61 is in the form of a hollow cylinder made of a non-magnetizeable and electroconductive material (for example, aluminum) and has its outer peripheral surface treated in any suitable manner, for example, sand-blasted, to have minute indentations, and is supported for rotation in a direction shown by the arrow e while confronting a photoreceptor drum 100 supported for rotation in a direction shown by the arrow f, counter to the direction e of rotation of the sleeve 61.

The magnetic roller 62 has its peripheral portion magnetized to N and S poles in a pattern as best shown in FIG. 1 and is fixed within the developing sleeve 61. More specifically, the peripheral portion of the magnetic roller 62 is alternately magnetized to N and S poles except for a region thereof confronting the bucket roller 16 where the poles of the same polarity adjoin each other as indicated by $S_2$ and $S_3$. It is to be noted that the magnetic pole indicated by $N_1$, which may be termed as a developing pole, is magnetized to 1,000 G, both of the magnetic poles $S_2$ and $S_3$, which may be termed as auxiliary poles, are magnetized to 600 G, and the remaining magnetic poles are magnetized to 600 G.

The tip of the bristle height restricting plate 63 confronts a portion of the developing sleeve 61 between the magnetic poles $N_3$ and $S_3$ of the magnetic roller 62 and is inclined at an angle of 60° relative to the horizontal plane.

One end of the casing 1 adjacent the photoreceptor drum 100 is rendered to be a spill preventing plate 6 raised to terminate immediately below a developing zone Y and generally in alignment with the magnetic poles $S_2$ of the magnetic roller 62. In other words, the magnetic pole $S_1$ is located at a position lying on the imaginary straight line passing through both the center of the developing sleeve 61 and the tip of the spill preventing plate 61.

While the developing unit 60 is so constructed as hereinbefore described, the developing mix is retained on the outer peripheral surface of the developing sleeve 61 while constrained by a magnetic force of the magnetic roller 62, and is transported in the direction e along the outer peripheral surface of the developing sleeve 61, based on the direction of rotation of the sleeve 61 in the direction e. The developer mix so transported is used at the developing zone Y to develop an electrostatic latent image formed on the outer peripheral surface of the photoreceptor drum 100. The amount of the developer mix being so transported can be regulated by cutting the bristles to a height corresponding to the size of a gap, delimited between the sleeve 61 and the restricting plate 63, as it passes underneath the restricting plate 63. Along therewith, the newly supplied developer mix is supplied, based on the rotation of the bucket roller 19 in the direction b, onto a portion of the outer periphery of the developing sleeve 61 confronting with the magnetic poles $N_2$ and $S_2$ of the magnetic roller 62. At this place, the developer mix separates away from the outer peripheral surface of the developing sleeve 61 under the influence of a magnetic force of repulsion emanating between the magnetic poles $S_2$ and $S_3$ of the magnetic roller 62 and subsequently impinges upon the restricting plate plate 63 to mix with the developer mix then counterflowing on this side thereof before it is transported to the developing zone Y past the restricting plate 63 in the manner as hereinbefore described.

Hereinafter, a toner concentration detecting control device will be described.

Figure 3:
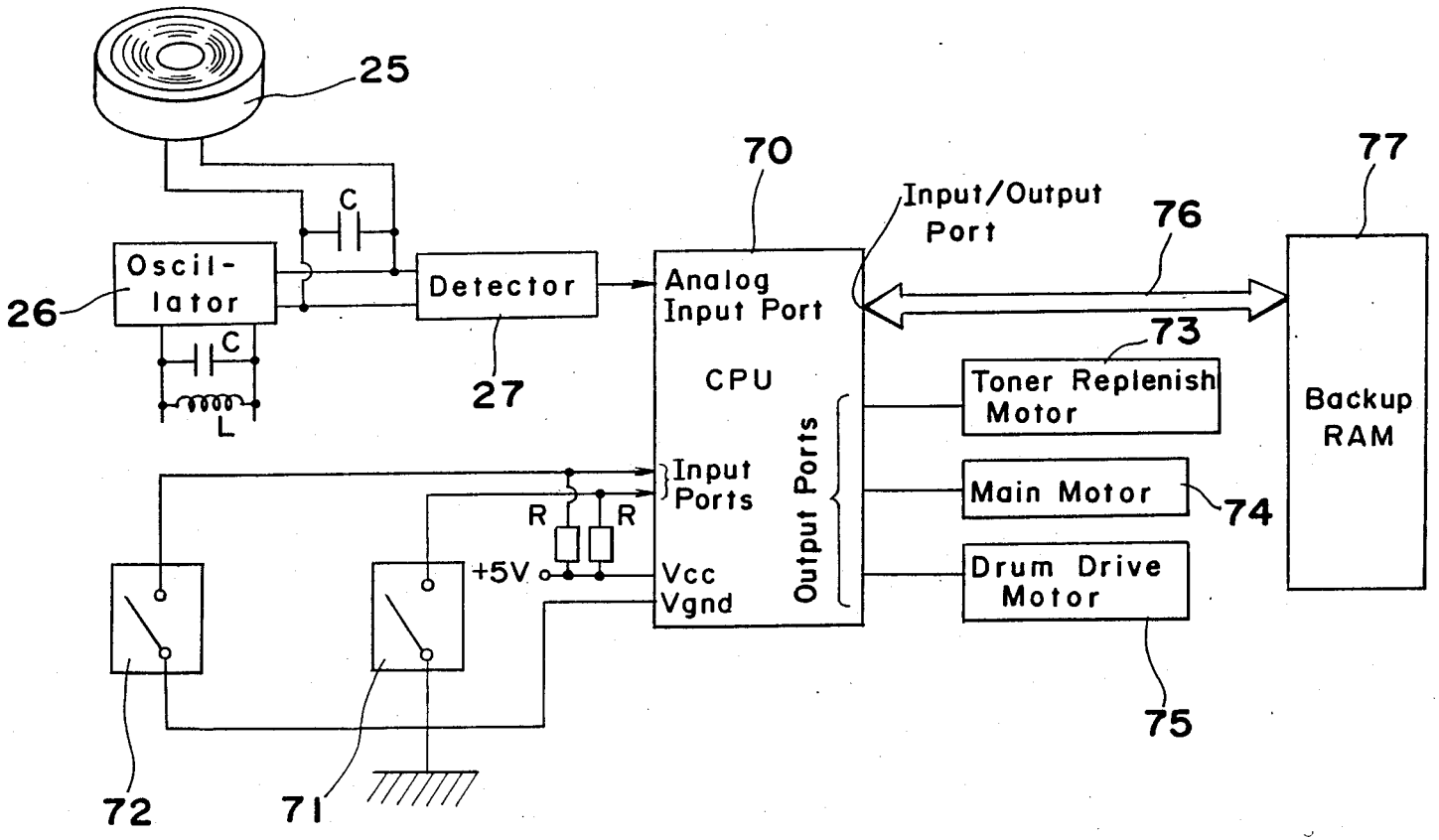
FIG. 3 is a block diagram showing a control circuitry.

In the first place, a control circuit will be described with reference to FIG. 3. This control circuit includes a microcomputer 70 as the heart thereof, and the magnetic sensor 25 for the detection of the toner concentration is operable to output to a detector 27 a signal from an oscillator 26 which is indicative of the change in permeability in the developer mix, an analog signal from the detector 27 being subsequently inputted to an analog input port of the microcomputer 70. A function switch 71 and a reference value setting switch 72, both arranged on the operating panel of the copying machine body, are connected with respeetive input ports of the microcomputer 70. The microcomputer 70 has a plurality of output ports connected respectively with a toner replenishing motor 73, a main motor 74 and a photoreceptor drum drive motor 75. The toner replenishing motor 73 is used to drive the toner replenishing roller 51 and the stirring member 42, the main motor 74 is used to drive the developing sleeve 61, the screw roller 12, and the bucket roller 16, and the drive motor 74 is used to drive the photoreceptor drum 100. The microcomputer 70 also has an input/output port connected with a battery back-up RAM (random access memory) 77 through a bus line 76.

It is to be noted that, since an output data from the detector 27 of the magnetic sensor 24 is an analog signal, it is inputted to the analog port of the micrcomputer 70 and is data-processed after having been converted into a digital signal by the use of an analog-to-digital converter.

While the control circuit is constructed as hereinabove described, at the time of installation of the copying machine or at the time of replacement of the developer mix subsequent to the machine installation, the developer mix preadjusted to a proper toner concentration is filled in a developer casing 5, and the function and reference value setting switches 71 and 72 are switched on to drive the main and drum drive motors 74 and 75 and to cause the toner concentration detected by the magnetic sensor 25 to be stored as a reference value in the battery back-up RAM 77.

At the time of development of the electrostatic latent image during each normal cycle of copying operation which takes place subsequently, the detection value of the magnetic sensor 25 and the reference value stored in RAM 77 are compared with each other in the microcomputer 70, and if the former is found to be lower than the latter, the toner replenishing motor 73 is driven for a predetermined time to supplement the new toner material into the passage 11. In this case, since the magnetic sensor 25 is positioned on the downstream side of the passage 15, the new toner material is supplemented into the upstream end of the passage 11 at the time the developer mix having its toner concentration detected as lowered moves onto the upstream end of the passage 11, and in this way, the control of the toner concentration takes place in quick response.

The processing procedure of the control circuit described above will now be described with reference to a flow chart shown in FIG. 4, et seqq.

Figures 4, 5:
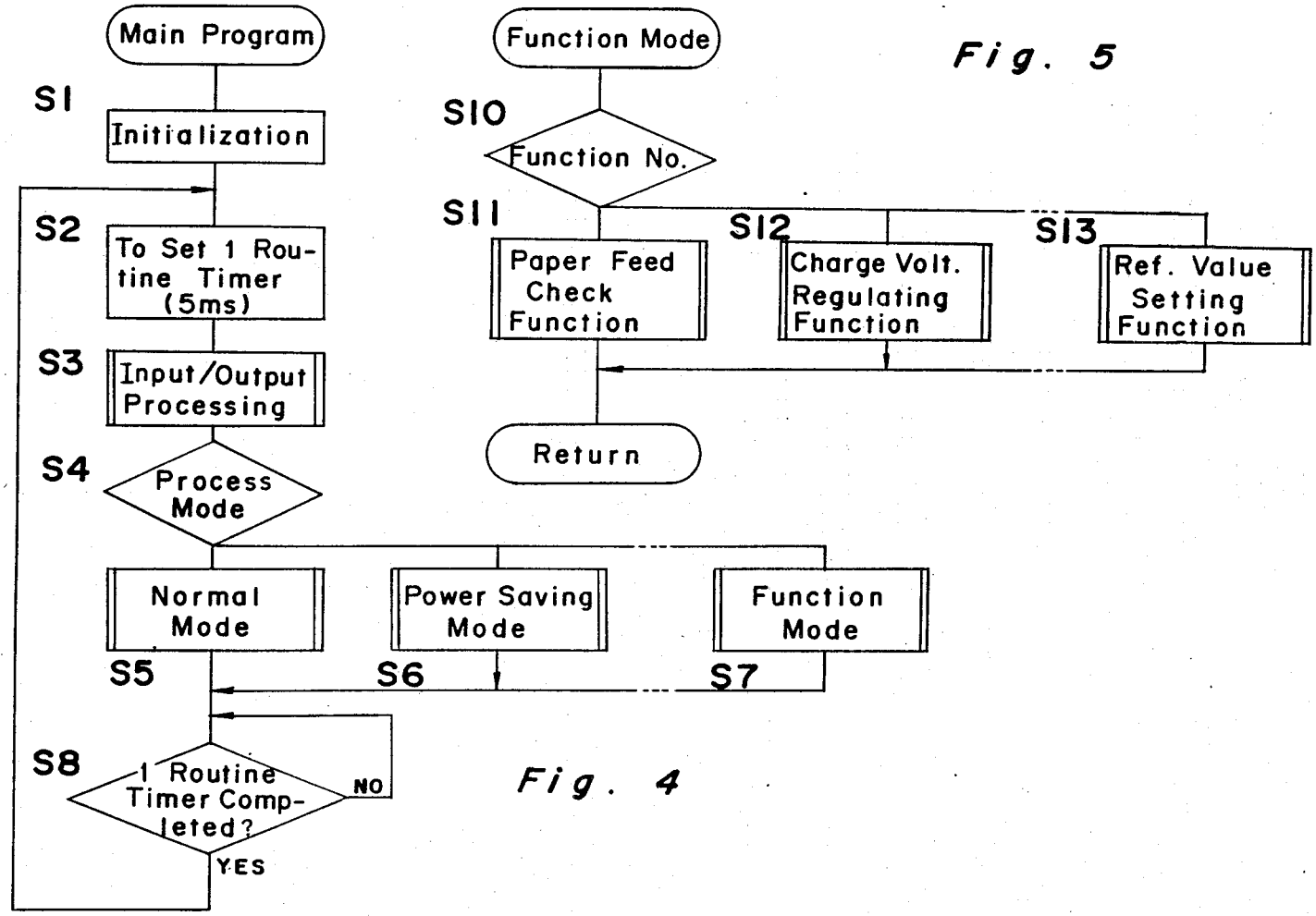
FIGS. 4 to 6 are flow charts showing the sequence of processing procedures.

FIG. 4 illustrates an overall processing routine (main routine) of the copying machine. Subsequent to the supply of electric power, a program of the microcomputer 70 is initialized at step S1, followed by the setting of a one-routine timer at step S2. This is for the purpose of executing a main routine processing for each time set (for example, 5 msec in the illustrated embodiment). At the subsequent step S3, an input/output processing is executed, wherein the microcomputer 70 interrogates with various measuring instruments, connected therewith, as to conditions of external information and loads. Thereafter, at step S4, a process mode is determined. The process mode available includes a normal mode at step S5, an electric power saving mode at step S6, and a function mode at step S7, and after the completion of any one of these modes and after the completion of the preset time of the one-routine timer at step S8, the program flow returns to step S2.

The normal mode at step S5 is a mode assumed during the normal copying operation and also during a standby condition preparatory to the copying operation, and during the execution of this normal mode, a front door of the copying machine body is closed and the process proceeds while the function switch 71 is switched on with a main switch to be switched off and various elements and loads are controlled in dependence on the copying operation. The power saving mode at step S6 is a mode wherein the copying operation is inhibited and the temperature of a toner image fixing roller is controlled to a lower value than that during the normal mode, and during the execution of this power saving mode, the front door of the copying machine body is closed and the process proceeds while both the main switch and an electric power saving switch are switched on. It is to be noted that, when the electric power saving switch is switched off, the temperature of the fixing roller increases and the normal mode is resumed.

The function mode at step S7 is executed when it is determined at step S4 that the function switch 71 has been switched on, and as shown in FIG. 5, the type of function to be executed is determined at step S10. The function available includes a paper feed check function at step S11, a charging voltage regulating function at step S12, a reference value setting function at step S13 and some other functions.

The reference value setting function at step S13 is a process constituting the essence of the present invention and wherein the reference value for the toner concentration is determined. This reference setting function is executed when both the function switch 71 and the reference value setting switch 72 are switched on while and after the developer mix having its toner concentration preadjusted to the proper value has been filled in the casing 5 at the time of or subsequent to the installation of the copying machine or the replacement of the developing mix.

Figure 6:
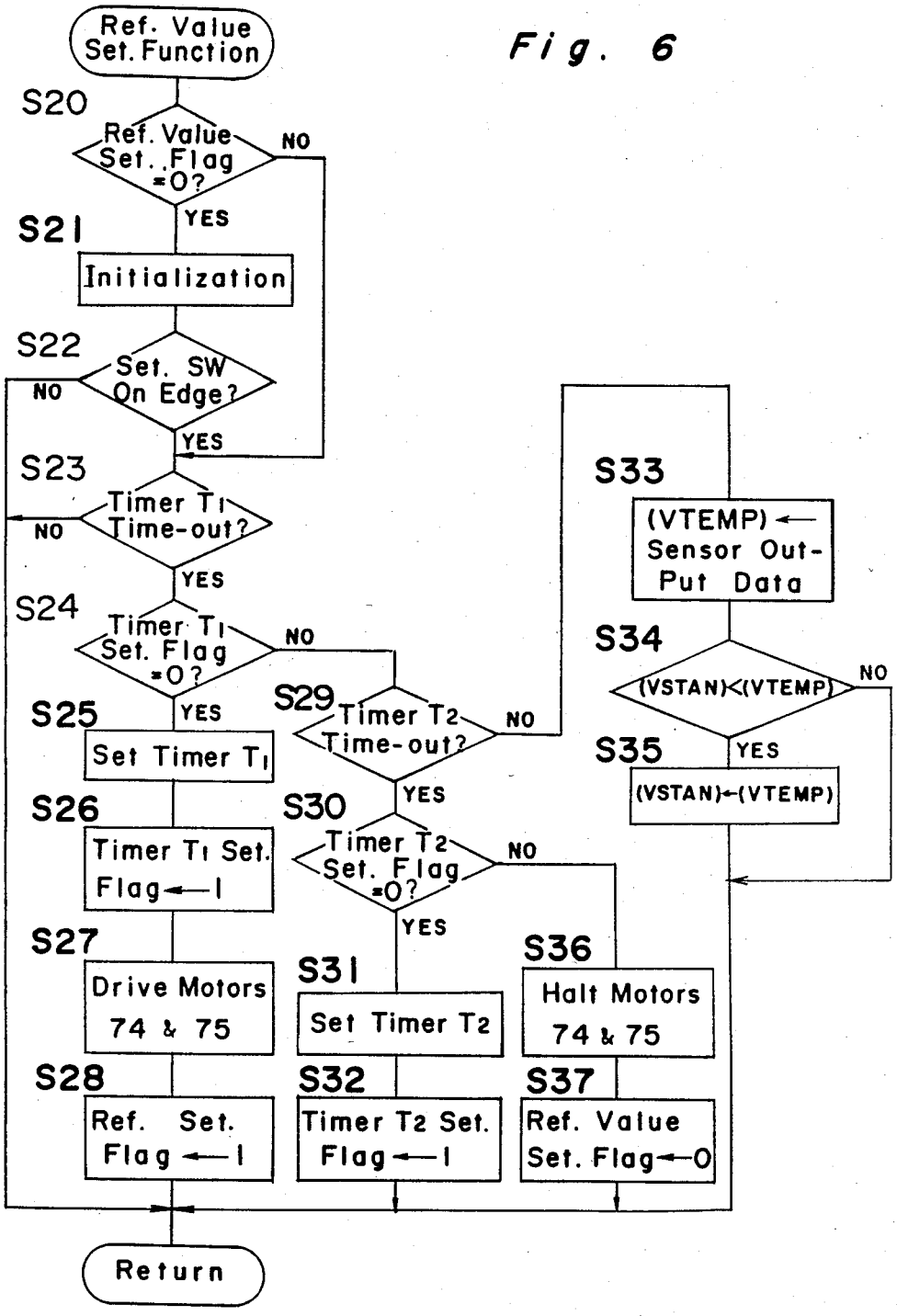

A processing routine for the reference value setting function is illustrated in FIG. 6. At step S20, a decision is made to determine if a reference value setting flag is "0". Since this reference value setting flag has been reset to "0" at step S1 (FIG. 4), the program flow proceeds to step S21 at which parameters for the subroutine are initialized. In other words, a timer $T_1$ set flag and a timer $T_2$ set flag are reset to "0", and a storing RAM to which a sampling data VTEMP of the toner concentration and a peak value data VSTAND thereof are inputted is reset to "0". A timer $T_1$ is used to power the main motor 74 and the drum motor 75 to effect the stirring and conveyance of the developer mix for a predetermined time. A timer $T_2$ is used to determine the timing at which the toner concentration is detected subsequently by the magnetic sensor 25 to obtain a sampling data.

When a down edge of a signal signifying that the reference value setting switch 72 has been switched on is confirmed at step S22, a decision is made at step S23 to determine if the timer $T_1$ has been timed out. Since the timer $T_1$ has not yet been set at this time, the program flow proceeds to step S24 at which a decision is made to determine if the timer $T_1$ set flag is "0". Since this timer $T_1$ set flag has been reset to "0" at step S21, the program flow proceeds to step S26 at which the timer $T_1$ is set to count 5 minutes. At the same time, the timer $T_1$ set flag is set to "1" at step S26, followed by step S27 at which both the main and drum motors 74 and 76 are powered and the reference value setting flag is set to "1" at step S28.

Thereby, the screw roller 12, the bucket roller 16 and the developing sleeve 61 all within the casing 5 are driven to rotate, wherefore the developer mix is mixed and stirred while distributed into the passages 11 and 15 with the total developer mix consequently passed over the outer peripheral surface of the developing sleeve 61. Therefore, the developer mix within the casing 5 is uniformly imparted with magnetism. This is because the embodiment of the present invention new under discussion is so constructed as to permit the toner concentration to be detected on the basis of change in magnetic characteristic of the developer mix. In addition, the photoreceptor drum 100 is also driven to rotate. This is for the purpose of avoiding such a possibility that the developer being transported over the outer peripheral surface of the developing sleeve 61 may brush one and the same locality of the outer peripheral surface of the photoreceptor drum 100 which would result in the localized wear of the outer peripheral surface of the drum 100.

If the result of a decision at step S23 indicates that the predetermined time of 5 minutes set in the timer $T_1$ has passed, and if the result of the subsequent decision at step S24 indicates "NO", the program flow proceeds to a decision step S29 to determine if the timer $T_2$ has been timed out. Since at this time the timer $T_2$ has not yet been set, the program flow proceeds to step S30 at which a decision is made to determine if the timer $T_2$ set flag is "0". Since the timer $T_2$ set flag has been reset to "0" at step S21, step S31 is performed to set one second to the timer $T_2$. At the same time, the timer $T_2$ set flag is set to "1" at step S32. That is, during the predetermined time of one second set in the timer $T_2$, steps S33, S34 and S35, as will be described later, are repeatedly executed at intervals of 5 msec in the one-routine timer (FIG. 4) to perform the data sampling of the toner concentration 20 times in total.

More specifically, at step S33, the output data VTEMP of the magnetic sensor 25 is inputted to the sampling data storage RAM, followed by step S34 at which the sampling data VTEMP is compared with the sampling peak value data VSTAN. If the data VTEMP is greater or higher or larger than the data VSTAN, the program flow proceeds to step S35 at which a peak value data storage RAM is updated to store the sampling data VTEMP. The peak value data VSTAN obtained during the execution of the subroutine of one second duration is stored through the bus line 76 into the battery back-up RAM 77 and is subsequently used as a reference value to be compared with the detection value of the magnetic sensor 25 in the toner concentration control during the succeeding cycles of copying operation.

The reason that the peak value data VSTAN of the sampling data VTEMP obtained during the predetermined time as hereinbefore described is used as the reference value is as follows. The magnetic sensor 25 is located adjacent the bucket roller 16 made of electroconductive material and, since electroconductive material moves by the magnetic sensor 25 incident to the rotation thereof, the detection output exhibits a waveform similar to that of an alternating current. In this case, the peak value data VSTAN is considered best representing information on the toner concentration. It is to be noted that the sampling period and/or the number of times of sampling may not be limited to that described in connection with the preferred embodiment of the present invention.

After the sampling incident to the lapse of one second which has been set in the timer $T_2$ with the consequence that the result of decision at step S29 is "YES", and if the result of decision at step S30 is "NO", both the main motor 74 and the drum drive motor 75 are switched off at step S36 and the reference value setting flag is subsequently reset to "0" at step S37, thereby completing the subroutine for the reference value setting function.

It is to be noted that the details of the processing procedure for the automatic toner concentration control during the normal copying operation are well known to those skilled in the art and will not, therefore, be reiterated.

From the foregoing description, it has now become apparent that, since the present invention is provided with the drive control means for the setting of the reference value which is operable to at least stir the developer mix within the developing device separately from normal developing operations, and also with the memory means for storing the reference value detected by the toner concentration detecting means at the time of reference value setting drive, the reference value which is automatically used as a reference for the toner concentration control can be obtained regardless of deviation in characteristic of the toner concentration detecting means, the developer mix replaced and others. Therefore, it is simple as compared with the fine adjustment and the re-setting, both performed by the servicing engineer, and the adjusted value (reference value) is proper and exact, making it possible to accurately control the toner concentration of the developer mix.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An electrostatic latent image developing apparatus for use in a copying machine or the like, which comprises:

a transport and supply means for circulating and transporting a developer mix filled in the developing apparatus, while mixing and stirring the developer mix, towards a developing means for developing an electrostatic latent image formed on an electrostatic latent image carrier surface;

a toner replenishing means for replenishing the transport and supply means with a new toner material;

a toner concentration detecting means for detecting a toner concentration of the developer mix within the developing apparatus;

a drive control means for the setting of a toner concentration reference value which is operable to at least stir the developer mix within the developing apparatus separately from normal developing operations;

a memory means for storing a reference value detected by the toner concentration detecting means at the time of driving toner concentration reference value setting; and a toner replenishment control means for comparing a detection value of the toner concentration detecting means with the toner concentration reference value during the normal developing operation and for actuating the toner replenishing means.

2. The apparatus as claimed in claim 1, wherein the developing means includes a developing sleeve supported for rotation counter to the image carrier surface and arranged so as to extend parallel to the image carrier surface, said sleeve being operable to transport the developer mix to a developing zone while retaining the developer mix on the outer peripheral surface of said sleeve.

3. The apparatus as claimed in claim 2, wherein the transport and supply means includes a screw roller disposed in parallel relationship with the developing sleeve and supported for rotation, said developer mix being transported by the rotation of the screw roller in a direction lengthwise of an parallel to the developing sleeve while being mixed and stirred.

4. The apparatus as claimed in claim 3, wherein the transport and supply means includes a bucket roller of electroconductive material disposed in parallel relationship with the developing sleeve and supported for rotation, said developer mix being transported, while circulated, by the rotation of the bucket roller in a direction lengthwise of and parallel to the developing sleeve while being supplied onto the outer peripheral surface of the developing sleeve.

5. The apparatus as claimed in claim 4, wherein the toner concentration detecting means is disposed adjacent a downstream end of the bucket roller with respect to the direction of transport of the developer mix.

6. The apparatus as claimed in claim 5, whrein the toner replenishing means supplies the developer mix in a direction upstream with respect to the direction of transport of the developer mix effected by the transport and supply means.

7. The apparatus as claimed in claim 1, wherein the drive control means is operable, when a reference value setting mode is selected, to drive the developing means, the transport and supply means and an electrostatic latent image carrier for a predetermined time to mix and stir the developer mix.

8. The apparatus as claimed in claim 7, wherein the drive control means is operable, when a toner concentration detection during the toner concentration reference value setting drive is completed, to halt respective rotations of the developing means, the transport and supply means and the electrostatic latent image carrier.

9. An electrostatic latent image developing apparatus for use in a copying machine or the like, which comprises:

a developing means for developing an electrostatic latent image formed on an electrostatic latent image carrier surface, said developing means including a roller disposed in parallel relation to an electrostatic latent image carrier for rotation counter to the image carrier surface;

a transport and supply means for circulating and transporting a developer mix filled in the developing apparatus, while mixing and stirring the developer mix, towards the developing means, said transport and supply means including rollers disposed in parallel relation to the roller of the developing means for rotation;

a toner replenishing means for replenishing a new toner material from an upstream side with respect to the direction of transport of the developer mix;

a toner concentration detecting means for detecting a toner concentration of the developer mix within the developing apparatus;

a drive control means for the setting of a toner concentration reference value which is operable to drive the developing means, the transport and supply means and the image carrier to at least stir the developer mix within the developing apparatus separately from normal developing operations;

a memory means for storing a reference value detected by the toner concentration detecting means at the time of driving toner concentration reference value setting; and a toner replenishment control means for comparing a detection value of the toner concentration detecting means with the toner concentration reference value during the normal developing operation and for actuating the toner replenishing means.

* * * * *